United States Patent [19]

Meier

[11] 4,026,443

[45] May 31, 1977

[54] SLIDE CLOSURE ARRANGEMENT FOR CONVERTERS

[75] Inventor: Ernst Meier, Kilchberg, Switzerland

[73] Assignee: Stopinc Aktiengesellschaft, Zug, Switzerland

[22] Filed: May 24, 1976

[21] Appl. No.: 689,150

[30] Foreign Application Priority Data

May 30, 1975 Germany ..... 2523928

[52] U.S. Cl. ..... 222/600; 266/271

[51] Int. Cl.[2] ..... B22D 41/08

[58] Field of Search ..... 266/236, 240, 271; 222/600, 561

[56] References Cited

UNITED STATES PATENTS

| | | | |
|---|---|---|---|
| 2,921,351 | 1/1960 | Momm | 222/600 X |
| 3,153,110 | 10/1964 | Sherburn et al. | 266/236 |
| 3,454,201 | 7/1969 | Fichera | 222/600 |
| 3,934,863 | 1/1976 | Norberg | 266/240 X |

*Primary Examiner*—Stanley H. Tollberg
*Assistant Examiner*—David A. Scherbel
*Attorney, Agent, or Firm*—Wenderoth, Lind & Ponack

[57] ABSTRACT

A flange of a tapping connection has extending outwardly therefrom pins which extend through a ring plate attached to the flange and through bores in a slide closure frame, thereby roughly aligning the frame. The ring plate has a centering ring which fits in an opening in the frame and thus precisely aligns the frame. The frame has aligning pins and attachment eyebolts, such that a completely assembled slide closure unit can be assembled to and disassembled from the frame.

9 Claims, 13 Drawing Figures

SLIDE CLOSURE ARRANGEMENT FOR CONVERTERS

BACKGROUND OF THE INVENTION

The present invention relates to a slide closure arrangement for the tapping of metallurgical vessels or furnaces, such as tipping converters and furnaces of the type including a flange provided on a tapping connection and an annular ring-shaped plate attached thereto to close the refractory lining at the connection of the tapping area.

It is well known that it is difficult to obtain a clean separation of the molten metal from the slag floating thereon in converters or tipping furnaces. In most cases, and especially toward the end of a tapping operation, either the slag passes into the ladle together with the molten metal, or the molten metal passes together with the slag into the slag-collecting crucible, since the converter cannot be raised with sufficient swiftness from the pouring position when the flow through the tapping connection changes from molten metal to slag. Until the present time it was not possible to attain an economical emptying of the converter together with a clean separation of molten and slag.

The above problem is considered to be solved in principle by the arrangement of a slide closure on the tapping connection of converters or furnaces. Such closure is customarily used on the spouts of metallurgical vessels, since the closure allows a prompt interruption of the tapping operation, so that the molten metal and the slag can be accurately separated.

However, the above solution is associated with a series of considerable difficulties, especially on blast steel converters, in particular in view of the required replacement of the refractory parts of the slide closure which are subjected to wear and the service life of which between replacement operations is relatively short. For example, the operation of a larger converter lasts about thirty days at the rate of approximately thirty daily charges. During such operation, the primary duty of the steel worker at the present time is to maintain the converter failure-free in operation.

Due to the conditions under which converters are presently operated, it may be expected that the slide closure parts subjected to wear must be replaced after approximately thirty charges, i.e. once daily, and the entire slide closure inclusive of the hydraulic drive must be inspected and overhauled once a week. This necessarily results in interruptions of the converter operation. Such interruptions, particularly considering the time required to repair the present slide closure arrangements, are unacceptable, especially since repairs cannot be undertaken on a slide closure while attached to the converter, due to the intensive thermal radiation of the tapping connection.

SUMMARY OF THE INVENTION

The object of the present invention is to provide for economical tapping of the molten metal with an improved and easily operable and replaceable slide closure arrangement on the tapping connection of a converter, and particularly wherein the slide closure can be repaired in a minimal amount The above object is achieved in acordance with the present invention by basically starting with a tapping connection having a flange to which a ring or annular plate is attached to operate as an outer closure for the refractory lining of the converter. Such a tapping connection is disclosed in German DT-AS No. 1,583,306.

In accordance with the present invention, the tapping connection flange has an approximate or rough aligning coupling arrangement for the slide closure frame, and the ring plate has a precise centering arrangement for the slide closure frame. The slide closure frame is provided with a guide arrangement and an attachment arrangement for coupling thereto a slide closure unit that is preassembled with the refractory parts which become subjected to wear, i.e. an inlet element, a bottom plate, a slide plate and an outlet element.

Since the parts which are subjected to wear must be replaced regularly, e.g. daily, by the arrangement of the present invention it is possible, after releasing the attachment arrangement of the slide closure unit, to remove such unit by means of a lifting tool and to replace it with a previously assembled and operational replacement slide closure unit. The guide arrangement of the slide closure frame provides for a precise alignment of the slide closure unit coaxially and in a plane perpendicular to the opening of the tapping duct. When the attachment arrangement is then operated, the provision of newly provided, rapid setting mortar insures the necessary tight connection between the face of the opening of the tapping duct and the face of the refractory inlet element of the slide closure. The slide closure unit can thus be replaced in a quick and safe manner.

When necessary, it is also possible to jointly remove and replace the slide closure unit with the slide closure frame, i.e. when the entire closure inclusive of the hydraulic drive must be inspected andoverhauled, e.g. once a week. After releasing the rough aligning and coupling arrangement provided for the slide closure frame on the tapping connection flange, the frame and the slide closure unit are jointly removed, and a new previously assembled and operational arrangement including a frame and slide closure unit is then attached to the rough aligning and coupling arrangement. During this operation, a centering means arranged on the ring plate automatically centers the slide closure frame in the operational position, whereat fresh mortar provides an effective seal between the opening of the tapping duct and the inlet of the slide closure.

The relatively quick replacement of the arrangement including the slide closure frame and the slide closure unit, or alternatively of the slide closure unit alone, is effected with a precision of attachment that guarantees safe and reliable operation of the slide closure. Furthermore, the slide closure arrangement of the present invention is excellently suitable for employment as the slide closure on converters or other furnaces in order to achieve an economically performable tapping operation in connection with careful separation of the melt and slag.

In further accordance with the slide closure arrangement of the present invention the rough aligning and coupling arrangement of the connection flange for the slide closure frame and means for fastening the ring plate to the flange are spaced about the circumference of an imaginary circle centered about the flange and plate. The rough aligning and coupling arrangement includes diametrically opposite insertion pins. The ring plate fastening means includes bores through the flange at positions between the pins, such bores receiving screws which extend through the ring plate. The ring plate has an outwardly extending centering ring whichis coaxial to the opening of the connection and which centers the slide closure frame by cooperation with a center opening therethrough. The slide closure frame has on the longitudinal sides thereof guide pins and hinged eyebolts for the coupling of the slide closure unit. The insertion pins of the connection flange should preferably be vertically aligned in pairs which diametrically face each other in the vertical direction of the vessel, and the bores in the frame through which the insertion pins extend should preferably be provided on longitudinal sides of the slide closure frame such that the frame can be keyed or wedged onto the pins. This arrangement requires a low construction expenditure.

Still further, it is advantageous to center the slide closure frame by means of the outer circumferential surface of the ring plate centering ring, and to provide the free central opening of the ring plate with a diameter sufficient to effect repair and replacement of the tapping duct bricks.

BRIEF DESCRIPTION OF THE DRAWINGS

The present invention will be described in more detail below with reference to the accompanying drawings, wherein.

DETAILED DESCRIPTION OF THE INVENTION

Figure 1:
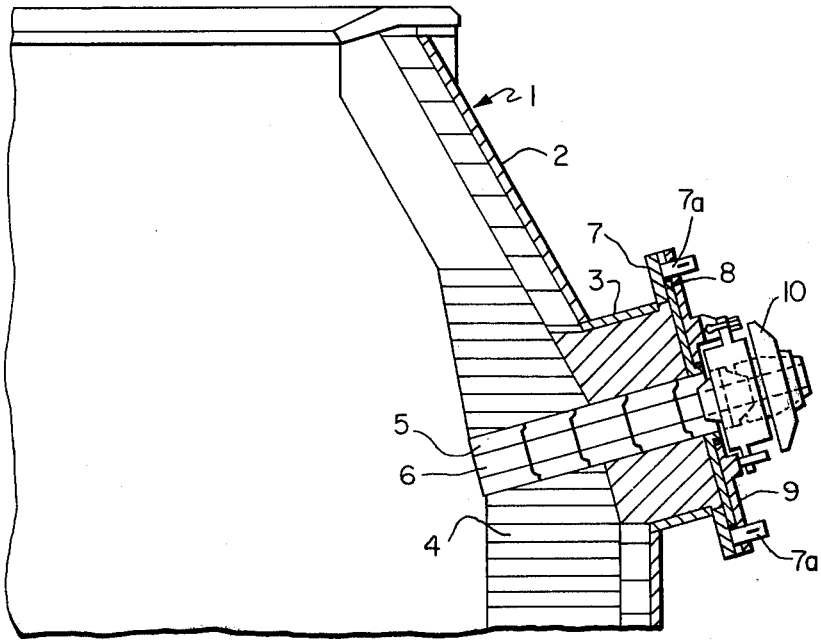
FIG. 1 is a section through a converter tapping arrangement having attached thereto a slide closure arrangement.

With reference now to FIG. 1, a converter 1, at the tapping area thereof, includes a sheet or plate metal shell 2 having attached thereto a tapping connection 3 and an inner refractory lining 4, which is ordinarily a compound or mass in the area of the connection. A tapping duct 6 is formed by duct bricks 5 through lining 4, the duct 6 extending from the interior of the converter to the exterior thereof. At the outer end of tapping connection 3 is formed an radially outwardly extending flange 7 to which is attached a ring or annular plate 8. A slide closure frame 9 is mounted on ring plate 8, and a slide closure arrangement 10 in the form of an assembled unit is mounted on frame 9.

Figure 2:
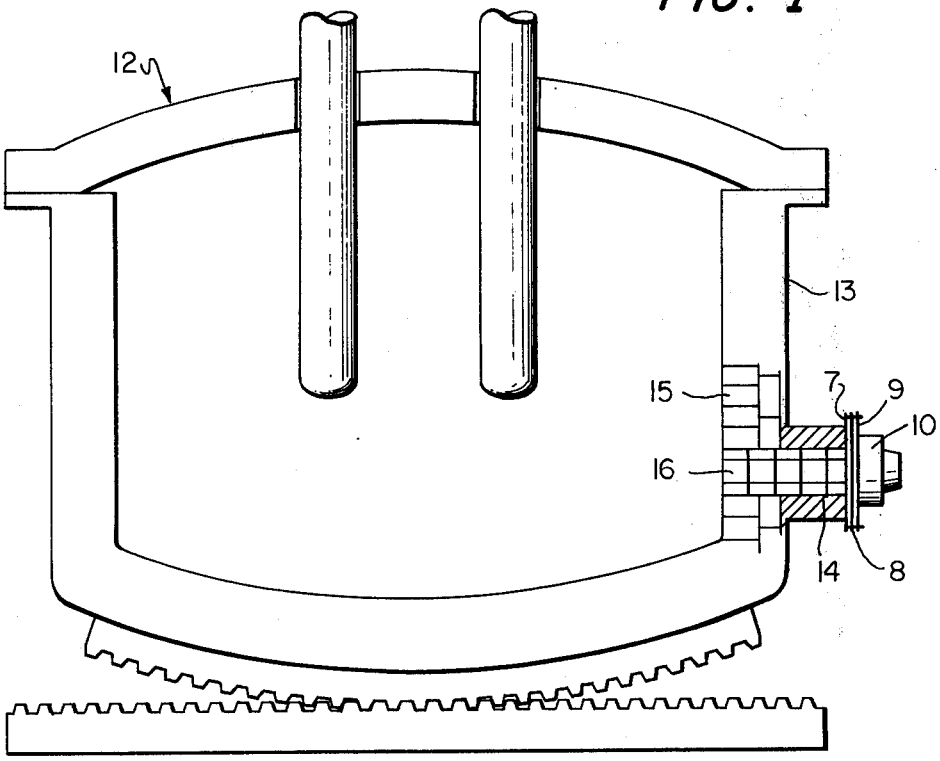
FIG. 2 is a section through a shcematically illustrated electric furnace, also having a slide closure attached to the tap opening.

The tipping electric furnace 12 illustrated in FIG. 2 has a sheet or plate metal shell 13, a tapping connection 14, a refractory lining 15 and a tapping duct 16. Electric furnace 12 has a tapping slide closure arrangement similar to that of the converter of FIG. 1 and including flange 7, ring plate 8, slide closure frame 9 and slide closure arrangement 10.

Figure 3:
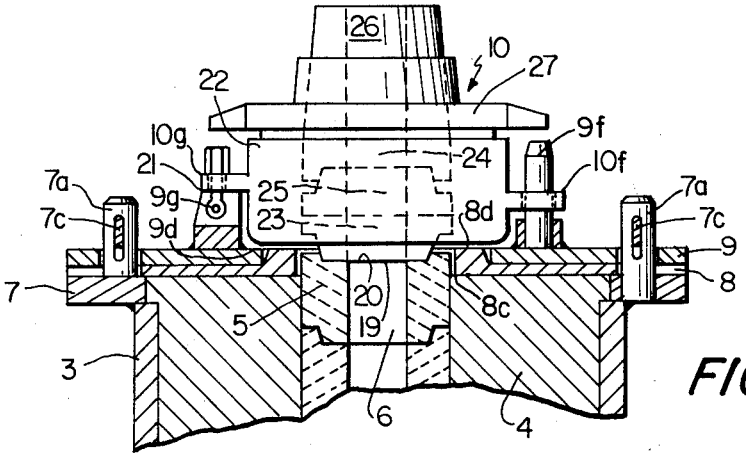
FIG. 3 is a partial section through a slide closure arrangement, similar to that shown in FIG. 1, but on an enlarged scale and taken along line III—III of FIG. 4.
Figure 5:
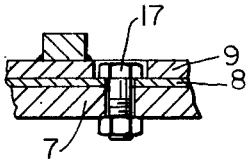
FIG. 5 is a section taken along line V—V of FIG. 4.
Figure 4:
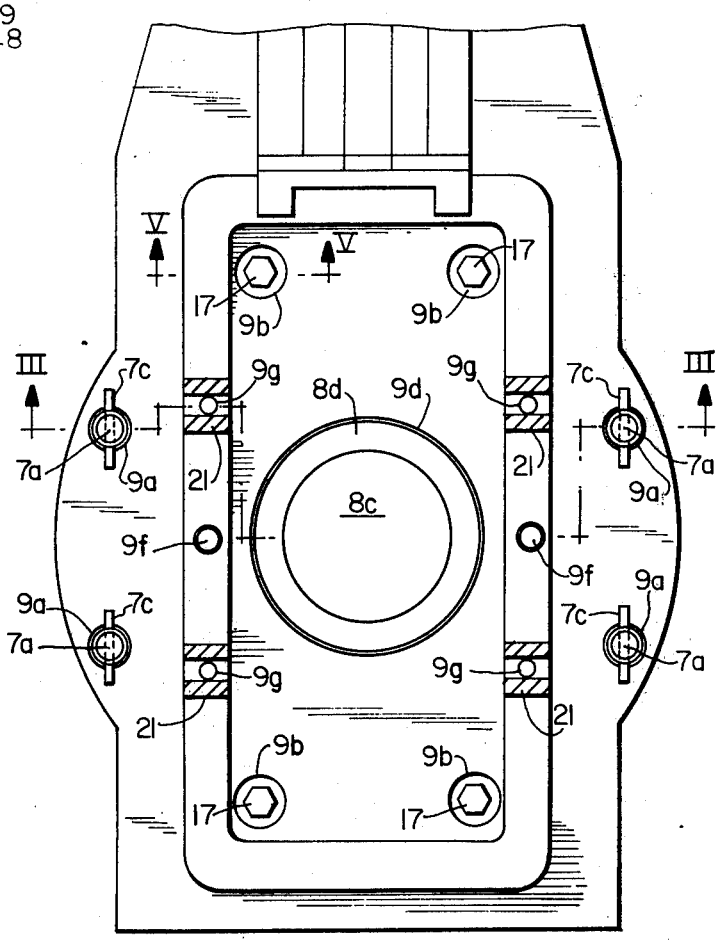
FIG. 4 is an exterior view of the slide closure frame.
Figure 6:
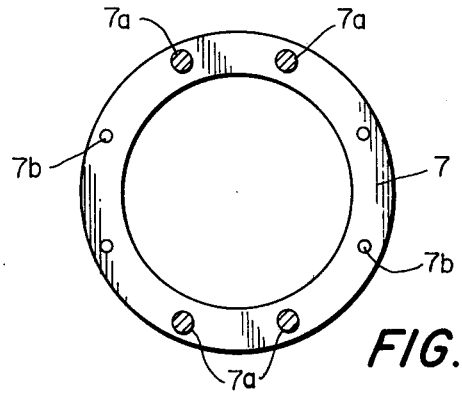
FIGS. 6 to 11 are plan and sectional views of the separate elements of the slide closure arrangement, FIGS. 8A and 9A representing a modified form of the ring plate illustrated in FIGS. 8 and 9.
Figure 7:
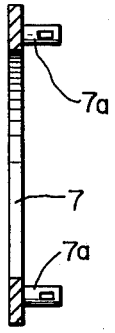
Figure 8:
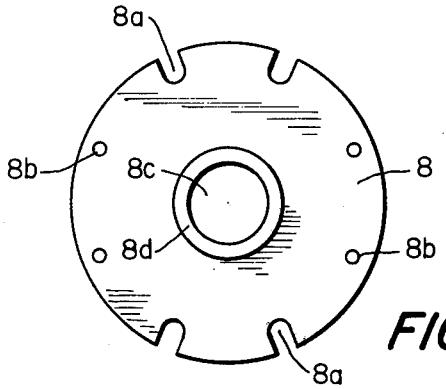
Figure 9:
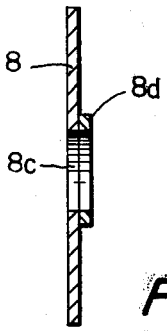
Figure 8A:
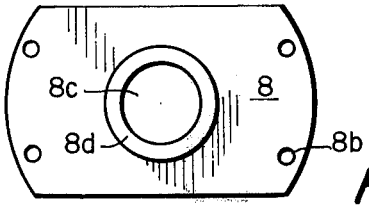
Figure 9A:
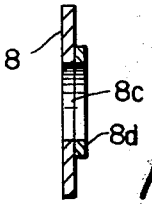

As shown in FIGS. 3 to 7, flange 7, which is rigidly connected to connection 3, e.g. by welding, possesses two diametrically opposite pairs of insertion pins 7*a* extending outwardly therefrom, with the pairs of pins being separated by intermediate diametrically opposite pairs of internally threaded bores 7*b*. Pins 7*a* and bores 7*b* are equally spaced about the circumference of an imaginary circle centered about the center of flange 7. Ring plate 8 is attached to flange 7 by means of bolts 17, as shown in FIGS. 4 and 5, bolts 17 passing through four bores 8*b* spaced about ring plate 8 to align with bores 7*b* in flange 7. Ring plate 8 also has therein marginally-open recesses 8*a* which are positioned to align with flange insertion pins 7*a* which extend through recesses 8*a*. Plate 8 seals that portion of refractory lining 4 situated in outlet connection 3 with respect to the exterior. However, plate 8 has a central opening 8*c* which permits free access to bricks 5 of tapping duct 6. Ring 8 has a centering ring 8*d* that projects outwardly therefrom around opening 8*c*. The outer circumferential surface of ring 8*d* centers a slide closure frame 9 by precise fitting engagement with the inner surface of passage opening 9*d* of frame 9.

Figure 10:
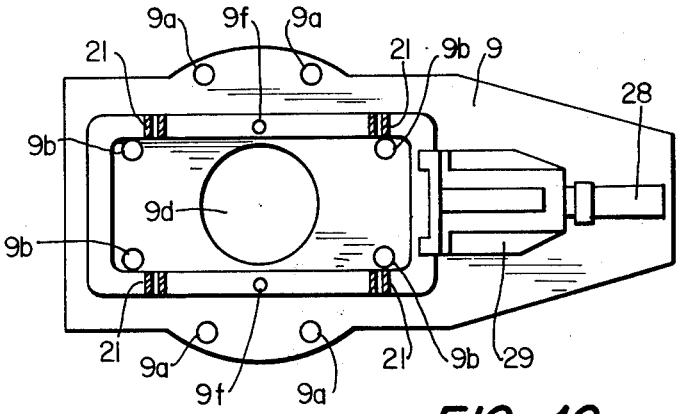
Figure 11:
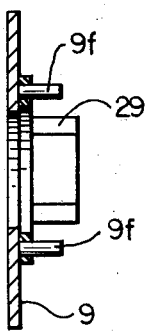

Frame 9, as shown in FIGS. 4, 10 and 11, has therethrough four bores 9*a* positioned to align with insertion pins 7*a*, by which frame 9 is moutned to flange 7 over ring plate 8. Frame 9 also has therethrough four enlarged bores 9*b* positioned to align with bores 8*b* to receive the head ends of bolts 17 projecting upwardly from ring plate 8 when frame 9 is attached to ring plate 8. Wedge fasteners 7*c* are wedged into openings in pins 7*a* to lock frame 9 in position with respect to plate 8 and flange 7. Opening 8*c* of ring plate 8 forms a window or door through which a slide closure inlet 19 can be directly connected to a tapping duct opening 20. Guide pins 9*f* are provided on slide closure frame 9 on opposite longitudinal sides of passage opening 9*d*, and a slide closure arrangement 10 has bored flanges 10*f* which slide over guide pins 9*f*, thereby facilitating alignment of inlet 19 and opening 20. For the final attachment of slide closure 10 to slide closure frame 9, two eyebolts 9*g* are hinged on each of the opposite longitudinal sides of frame 9, which eyebolts 9*g* may be swung into slit bosses 10*g* of closure 10. Thereafter, by tightening of nuts threaded to eyebolts 9*g* the slide closure is urged toward abutments 21 of frame 9. Therefore, and due to the mutually tapered fitting between slide closure inlet 19 and tapping duct opening 20, an operationally reliable connection may be formed between the refractory parts with the use of fresh mortar.

As shown in FIG. 3, slide closure 10 as an assembled structural unit basically includes a housing 22 having therein a fixed refractory bottom plate 23, a slide 24 including a refractory slide plate 25 and an outlet sleeve 26, and a housing cover 27. Housing 22 and housing cover 27 are fastened together, in a known manner which is not shown or the sake of simplicity, so that the sliding surfaces of bottom plate 23 and slide plate 25 are pressed against each other in a sealing manner while allowing sliding therebetween. Slide plate 25 carried by slide 24 is displaced by a hydraulic cylinder 28 (FIG. 10) arranged on holders 29 of slide closure frame 9 and coupled to slide 24.

The above slide closure arrangement makes it possible to effect the following replacement operations.

As mentioned above, bottom plate 23 that wears down at regular intervals of time under constant operational conditions, together with inlet 19, slide plate 25 and outlet sleeve 26 are the elements which must be most frequently replaced. To achieve replacement of these elements, eyebolts 9*g* are loosened and slide closure structural unit 10 is removed from guide pins 9*f*, e.g. by means of mechanical lifting tools. Thereafter a new, completely assembled replacement unit 10 is positioned on pins 9*f* and fastened thereon by tightening eyebolts 9*g*. The removed slide closure unit 10 is repaired and rendered operational and made ready to be used again. Defects in opening 20 of tapping duct 6 which may be observed during the removal of slide closure structural unit 10 can be repaired through opening 8*c* of ring plate 8. Itis also possible to repair or replace tapping duct bricks 5 through opening 8*c* .

When slide closure frame 9 and/or hydraulic drive elements 28 and 29 arranged thereon must be replaced, wedge fasteners 7*c* are removed from insertion pins 7*a*, and frame 9 and the slide closure unit 10 mounted thereon are jointly removed and replaced by an assembled replacement two-part unit 9 and 10. However, it is also possible to mount a new operational slide closure frame 9 and a new operational slide closure unit 10 one after another. In either case, centering ring 8*d* of ring plate 8 automatically guides slide closure frame 9 into the correct operative positon. It is possible, in this case, to perform repairs on opening 20 of the tapping duct between the operations of disassembly and assembly.

When larger repairs are to be made on the refractory material of the tapping area, ring plate 8 can be removed after bolts 17 are loosened. For reassembly, plate 8 is again properly centered with respect to flange 7 by fitting edge recesses 8*a* over pins 7*a*.

From the above it will be apparent that every necessary replacement and repair operation required for guaranteeing the operational reliability of the slide closure can be carried out in a simple manner and in a relatively short time.

It will be apparent that various modifications may be made to the above specifically described arrangements without departing from the scope of the invention.

What is claimed is:

1. A slide closure and tapping arrangement for tapping metallurgical vessels or furnaces, such as tipping converters, of the type including a metal shell, a tapping connection attached to said shell, a refractory lining within said shell, and a tapping duct extending through said lining to said tapping connection, said slide closure and taping arrangement comprising:

a radially outwardly extending flange attached to the outer end of said tapping connection;

a ring plate attached to said flange and forming a closure for said lining;

a slide closure frame positioned on said ring plate;

means on said flange for roughly aligning said frame in a desired operative position on said ring plate;

centering means on said ring plate for precisely aligning said frame in said desired operative position;

a preassembled slide closure unit positioned on said frame; and means on said frame for aligning and attaching thereto said slide closure unit.

2. An arrangement as claimed in claim 1, wherein said means for roughly aligning said frame are equally radially spaced from a central axis of said flange, and said means for aligning and attaching said slide closure unit are equally radially spaced from said central axis.

3. An arrangement as claimed in claim 1, wherein said means for roughly aligning said frame comprises pins extending outwardly from said flange, and bores in said frame at positions aligned with said pins.

4. An arrangement as claimed in claim 3, wherein said centering means comprises a centrally located ring extending outwardly from said ring plate, and a complementary shaped formation in said frame for mating engagement with said ring.

5. An arrangement as claimed in claim 4, wherein said formation comprises an opening in said frame, the inner circumferential surface of said opening contacting the outer circumferential surface of said ring.

6. An arrangement as claimed in claim 3, wherein said flange has therein threaded bores at positions between said pins, said ring plate being attached to said flange by bolts threaded into said threaded bores.

7. An arrangement as claimed in claim 1, wherein said ring plate has a central opening therein, said central opening being of a diameter sufficient to enable therethrough the repair of said tapping duct.

8. An arrangement as claimed in claim 1, wherein said means for aligning said slide closure unit comprise pins extending outwardly from said frame, and openings in said slide closure unit aligned with said pins.

9. An arrangement as claimed in claim 1, wherein said means for attaching said slide closure unit comprise eyebolts hinged to said frame and means cooperable with said eyebolts for pressing said slide closure unit toward said frame.

* * * * *